US009580267B2

(12) United States Patent
Noda et al.

(10) Patent No.: US 9,580,267 B2
(45) Date of Patent: Feb. 28, 2017

(54) SHEET DISCHARGE DEVICE AND IMAGE FORMING APPARATUS

(71) Applicant: KYOCERA Document Solutions Inc., Osaka (JP)

(72) Inventors: Tatsuo Noda, Osaka (JP); Jiro Nagira, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 169 days.

(21) Appl. No.: 14/666,102

(22) Filed: Mar. 23, 2015

(65) Prior Publication Data

US 2015/0274479 A1 Oct. 1, 2015

(30) Foreign Application Priority Data

Mar. 26, 2014 (JP) ..... 2014-063046

(51) Int. Cl.
*B65H 31/04* (2006.01)
*B65H 29/00* (2006.01)
(Continued)

(52) U.S. Cl.
CPC ..... *B65H 31/04* (2013.01); *B65H 29/00* (2013.01); *B65H 31/10* (2013.01); *B65H 31/26* (2013.01); *B65H 37/04* (2013.01); *B65H 43/06* (2013.01); *G03G 15/6552* (2013.01); *B65H 2301/133* (2013.01); *B65H 2301/421* (2013.01); *B65H 2301/4219* (2013.01); *B65H 2301/42194* (2013.01); *B65H 2405/11151* (2013.01); *B65H 2511/13* (2013.01); *B65H 2511/152* (2013.01);
(Continued)

(58) Field of Classification Search
CPC ... B65H 31/04; B65H 31/10; B65H 2301/421; B65H 2511/13; B65H 2801/27
USPC ..... 270/58.02, 58.13, 58.19, 58.28
See application file for complete search history.

(56) References Cited

U.S. PATENT DOCUMENTS 6,145,826 A * 11/2000 Kawata ..... 270/58.28
6,302,389 B1 * 10/2001 Kato et al. ..... 270/58.13
(Continued)

FOREIGN PATENT DOCUMENTS

JP 2000-059552 A 2/2000
JP 2000-086063 A 3/2000

OTHER PUBLICATIONS

Extended European Search Report dated Sep. 21, 2015 mailed in the corresponding European Patent Application No. 15160952.6.

*Primary Examiner* — Leslie A Nicholson, III
(74) *Attorney, Agent, or Firm* — IP Business Solutions, LLC

(57) ABSTRACT

In a post-processing device (sheet discharge device), a pile thickness calculating section calculates, from a type and the number of paper sheets discharged through a sheet output port, a thickness of a pile, at its leading end, of sets of paper sheets on a sheet output tray (piling section), calculates a thickness of the pile, at its trailing end, of sets of paper sheets on the sheet output tray from an amount of movement of a lifting section, and calculates an angle of inclination of the uppermost set of paper sheets in the pile from the thicknesses of the pile at its leading and trailing ends, a height of inclination of the sheet output tray, and a length of the paper sheets. The control section controls the sheet discharge section to change a manner of discharging a subsequent set of paper sheets according to the calculated angle of inclination.

7 Claims, 4 Drawing Sheets

(51) Int. Cl.

| | |
|---|---|
| ***B65H 31/10*** | (2006.01) |
| ***B65H 31/26*** | (2006.01) |
| ***B65H 37/04*** | (2006.01) |
| ***B65H 43/06*** | (2006.01) |
| ***G03G 15/00*** | (2006.01) |

(52) U.S. Cl.
CPC ..... *B65H 2511/21* (2013.01); *B65H 2511/514* (2013.01); *B65H 2701/18292* (2013.01); *B65H 2801/27* (2013.01); *G03G 2215/00911* (2013.01)

(56) References Cited

U.S. PATENT DOCUMENTS

| | | | | |
|---|---|---|---|---|
| 6,471,429 | B1 | 10/2002 | Isobe et al. | |
| 7,549,621 | B2 * | 6/2009 | Kotani | 270/58.13 |
| 7,762,541 | B2 * | 7/2010 | Harashina | 270/58.13 |
| 8,100,391 | B2 * | 1/2012 | Terao et al. | 270/58.13 |
| 8,196,922 | B2 * | 6/2012 | Dobashi | 271/213 |
| 8,286,959 | B2 * | 10/2012 | Harashina | 270/58.28 |

* cited by examiner

SHEET DISCHARGE DEVICE AND IMAGE FORMING APPARATUS

INCORPORATION BY REFERENCE

This application claims priority to Japanese Patent Application No. 2014-63046 filed on Mar. 26, 2014, the entire contents of which are incorporated by reference herein.

BACKGROUND

The present disclosure relates to sheet discharge devices and image forming apparatuses and particularly relates to a technique for preventing dropping of paper sheets piled on a piling section.

Image forming apparatuses and the like include those equipped with a sheet discharge device configured to discharge paper sheets after image formation or after post-processing, such as punching or stapling, and receive and pile the discharged paper sheets on a sheet output tray. If in such a sheet discharge device, for example, a pile of paper sheets on the sheet output tray becomes significantly out of alignment during piling up of the paper sheets, subsequent paper sheets can no longer properly be piled on the sheet output tray. Therefore, a technique is employed in which when a detection sensor or the like detects that the top surface of a pile of paper sheets on the sheet output tray is not at a proper vertical position with respect to a sheet output port, the sheet output tray is lowered a certain amount and then lifted to correct the top surface of the pile of paper sheets on the sheet output tray to the proper vertical position.

Generally, the sheet output tray has an upward inclination in a direction of discharge of paper sheets. Therefore, paper sheets are piled on top of one another on the sheet output tray while taking an inclined position where their trailing ends in the direction of discharge are located below their leading ends in the direction of discharge. Thus, even if a large number of paper sheets are piled on the sheet output tray, the pile of paper sheets is less likely to collapse. Furthermore, because of the presence of the inclination, the paper sheet discharged through the output port in the apparatus body toward the sheet output tray moves on the sheet output tray while going down toward the apparatus body, which prevents dropping of the paper sheet from on the sheet output tray.

However, as stapled sets of paper sheets are successively piled on top of one another on the sheet output tray, their trailing end-side stapled portions of greater thickness are superimposed one on another and the thickness of the pile of sets of paper sheets is increased more at its trailing end in the direction of discharge of the sets of paper sheets than at its leading end in the direction of discharge, resulting in gradually reduced inclination of the top surface of the pile of sets of paper sheets. As a result, subsequently discharged paper sheets may slide off the sheet output tray or the pile of sets of paper sheets may collapse.

To solve the above problem, a technique is proposed in which when, during discharge of stapled sets of paper sheets to the inclined sheet output tray as in the above case, the superposition of stapled portions located at the same position in a pile of the sets of paper sheets on the sheet output tray reaches a predetermined amount, a subsequent stapled set of paper sheets is discharged to a location offset from that of the previous stapled set of paper sheets to avoid further superposition of the stapled portions and in turn avoid the thickness of the pile of sets of paper sheets from increasing more at its trailing end.

A technique is also proposed in which paper sheets are collected face down and face up alternately every predetermined number of sets and each set of collected paper sheets is stapled at a predetermined portion thereof and then discharged to an inclined sheet output tray as in the above technique to avoid superposition of the stapled portions and in turn avoid the thickness of a pile of sets of paper sheets on the sheet output tray from increasing more at its trailing end.

SUMMARY

A technique improved over the aforementioned techniques is proposed as one aspect of the present disclosure.

A sheet discharge device according to an aspect of the present disclosure includes a sheet discharge section, a stapler, a piling section, a lifting section, a top surface detecting section, a discharge detecting section, a control section, and a pile thickness calculating section.

The sheet discharge section is configured to discharge a set of paper sheets through a sheet output port.

The stapler is configured to, before the set of paper sheets is discharged through the sheet output port, apply a staple to a predetermined location on a trailing end portion of the set of paper sheets in a direction of discharge thereof.

The piling section is capable of being piled with sets of paper sheets discharged through the sheet output port, while a pile of the sets of paper sheets on the piling section being inclined so that a trailing end of the pile of the sets of paper sheets in the direction of discharge is located below a leading end thereof in the direction of discharge.

The lifting section is configured to vertically lift and lower the piling section toward and away from the sheet output port.

The top surface detecting section is configured to detect that a trailing end, in the direction of discharge, of a top surface of the pile of the sets of paper sheets on the piling section capable of being lifted and lowered by the lifting section has reached a predetermined sheet receiving height.

The discharge detecting section is configured to detect that the set of paper sheets has been discharged through the sheet output port to the piling section.

The control section is configured to, when the discharge detecting section detects that the set of paper sheets has been discharged to the piling section, allow the lifting section to lower the piling section by a certain amount and then lift the piling section from a lowered position where the piling section lowered by the certain amount is located to a position where the trailing end, in the direction of discharge, of the top surface of the pile of the sets of paper sheets on the piling section is detected by the top surface detecting section.

The pile thickness calculating section is configured to calculate, from a type and the number of paper sheets constituting each of the sets of paper sheets discharged through the sheet output port and the number of the discharged sets of paper sheets, a thickness of the pile, at the leading end thereof in the direction of discharge, of the sets of paper sheets on the piling section, calculate a thickness of the pile, at the trailing end thereof in the direction of discharge, of the sets of paper sheets on the piling section from an amount of movement of the piling section from the lowered position to the position where the trailing end of the top surface of the pile in the direction of discharge is detected by the top surface detecting section, and calculate an angle of inclination of the uppermost of the sets of paper sheets piled on the piling section with respect to a horizontal plane from the calculated thicknesses of the pile, at the leading and trailing ends in the direction of discharge, of the sets of paper sheets on the piling section, a height of inclination of the piling section, and a length of the paper sheets constituting the pile of the sets of paper sheets.

The control section is further configured to control the sheet discharge section to change a manner of discharging a subsequent set of paper sheets according to the calculated angle of inclination.

An image forming apparatus according to another aspect of the present disclosure includes the aforementioned sheet discharge device, an image forming section, and a notifying section.

The image forming section is configured to form an image on the paper sheet.

The notifying section is configured to give notice to a user.

The control section is further configured to, when the angle of inclination becomes nearly horizontal, allow the sheet discharge section to stop discharging a next paper sheet to the piling section and allow the notifying section to give a warning notice to the user.

DETAILED DESCRIPTION

Figure 1:
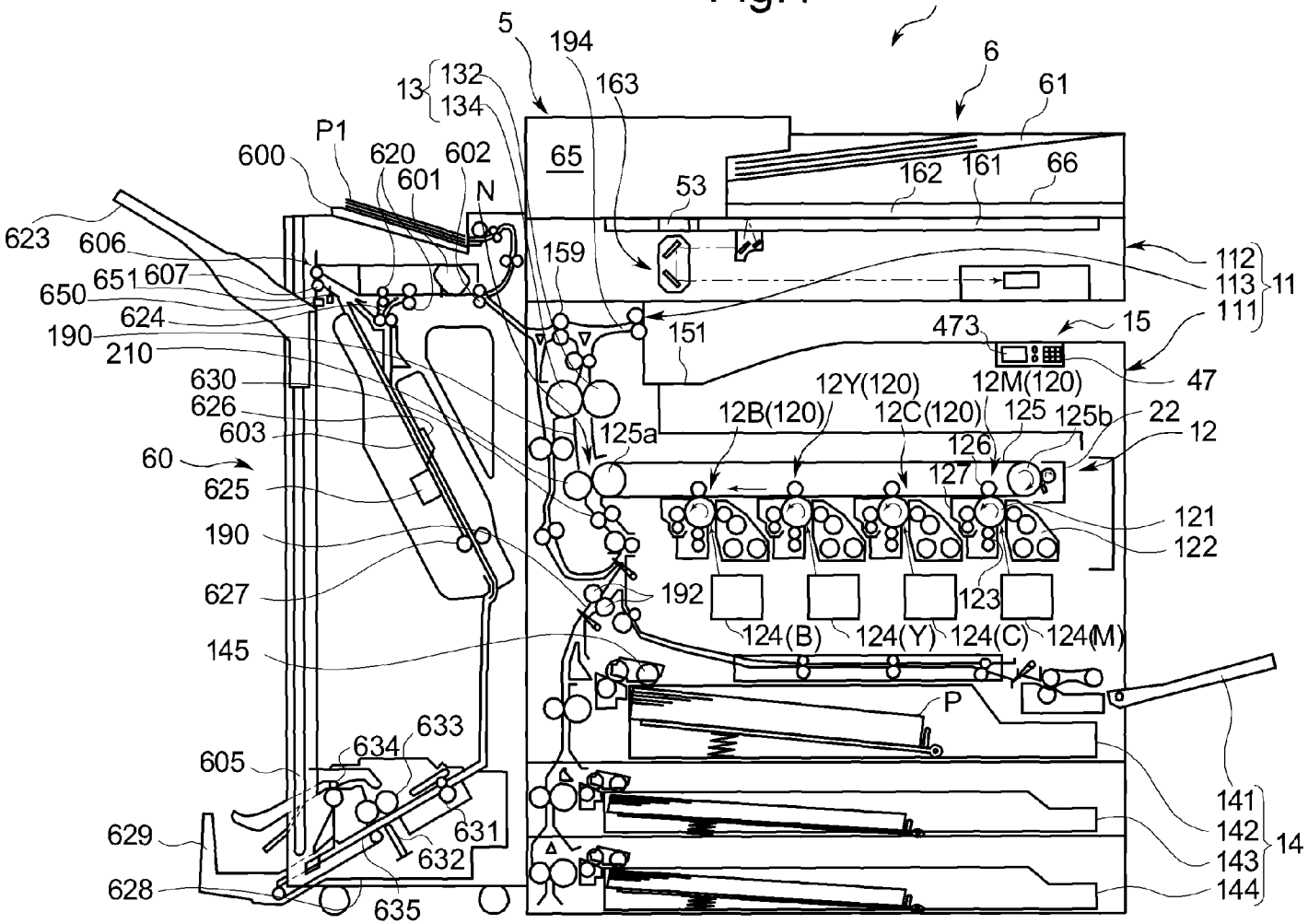
FIG. 1 is a view showing the structures of a sheet discharge device and an image forming apparatus according to one embodiment of the present disclosure.

Hereinafter, a description will be given of a sheet discharge device and an image forming apparatus according to one embodiment of the present disclosure with reference to the drawings. FIG. 1 is a view showing the structures of the sheet discharge device and the image forming apparatus according to the one embodiment of the present disclosure. The image forming apparatus 1 is a multifunction peripheral having multiple functions including, for example, a copy function, a print function, a scan function, and a facsimile function. The image forming apparatus 1 is made up so that an apparatus body 11 includes an image forming section 12, a fixing section 13, a sheet feed section 14, a sheet output mechanism 15, a document conveyance section 6, a document reading section 5, and so on. The image forming apparatus further includes a sheet discharge device (post-processing device) 60 according to the one embodiment of the present disclosure.

The apparatus body 11 includes a lower body 111, an upper body 112 opposed to and above the lower body 111, and a connecting portion 113 provided between the upper body 112 and the lower body 111. The connecting portion 113 connects the lower body 111 and the upper body 112 to each other, with the sheet output mechanism 15 formed between the lower and upper bodies 111, 112. The upper body 112 is supported by the upper end of the connecting portion 113. The upper body 112 is provided with the document reading section 5 and the document conveyance section 6.

The document reading section 5 includes an original glass plate 161 fitted to the top of the upper body 112; an openable/closable original cover 162 for holding an original document placed on the original glass plate 161; and a reader 163 for reading an image of the original document placed on the original glass plate 161. The reader 163 is configured to optically read the image of the original document using a CCD (charge coupled device) or so on to generate image data.

The document conveyance section 6 includes a document loading table 61 on which original documents are to be placed, a document ejection portion 66 to which original documents after image reading are to be ejected, and a document conveyance mechanism 65. The document conveyance mechanism 65 includes an unshown sheet feed roller, an unshown conveyance roller, and an unshown sheet reversing mechanism. The document conveyance mechanism 65 is configured to feed original documents placed on the document loading table 61 sheet by sheet by the drive of the sheet feed roller, convey the document to a position facing a document read slit 53 by the drive of the conveyance roller to allow the reader 163 to read the document through the document read slit 53, and then eject it to the document ejection portion 66.

The document conveyance section 6 is pivotally mounted to the upper body 112 so that its front side can be moved upward. When the front side of the document conveyance section 6 is moved up to make the top surface of the original glass plate 161 as a document table open, the user can place, on the top surface of the original glass plate, an original document to be read, for example, an open book with facing pages.

The lower body 111 is internally provided with the image forming section 12, the fixing section 13, and the sheet feed section 14. The sheet feed section 14 includes a plurality of sheet feed cassettes 142, 143, 144 insertable into and removable from the apparatus body 11. Each of the sheet feed cassettes 142, 143, 144 contains a sheet stack P1 formed of a plurality of sheets of recording paper medium (hereinafter, referred to simply as paper sheets) stacked on top of one another.

The image forming section 12 is configured to perform an image forming operation of forming a toner image on a recording paper sheet fed from the sheet feed section 14. The image forming section 12 includes a magenta image forming unit 12M, a cyan image forming unit 12C, an yellow image forming unit 12Y, and a black image forming unit 12B which are sequentially arranged from upstream to downstream in the running direction of an intermediate transfer belt 125 (hereinafter, each image forming unit is also called an "image forming unit 120" when referred to without distinction). The magenta image forming unit 12M uses magenta toner. The cyan image forming unit 12C uses cyan toner. The yellow image forming unit 12Y uses yellow toner. The black image forming unit 12B uses black toner. The image forming section 12 also includes the intermediate transfer belt 125 mounted between a plurality of rollers including a drive roller (roller opposed to a secondary transfer roller described below) 125*a* to be able to endlessly run in a direction of sub scanning for image formation, and a secondary transfer roller 210 which engages against a portion of the intermediate transfer belt 125 wound around the drive roller 125*a* on the outer peripheral side of the intermediate transfer belt 125.

Each image forming unit 120 includes a photosensitive drum 121, a developing device 122 operable to supply toner to the photosensitive drum 121, a toner cartridge (not shown) for holding toner, a charging device 123, an exposure device 124, a primary transfer roller 126, and a drum cleaning device 127.

The photosensitive drum 121 is configured so that an electrostatic latent image and a toner image corresponding to the electrostatic latent image can be formed on its peripheral surface. The developing device 122 is configured to supply toner to the associated photosensitive drum 121. Each developing device 122 is supplied with toner from the associated toner cartridge as needed.

The charging device 123 is disposed just below the associated photosensitive drum 121. The charging device 123 is configured to electrostatically and uniformly charge the peripheral surface of the associated photosensitive drum 121.

The exposure device 124 is provided below the photosensitive drum 121 and further below the charging device 123. The exposure device 124 is configured to irradiate the peripheral surface of the charged photosensitive drum 121 with laser light corresponding to each color based on image data input from a computer or the like or image data acquired by the document reading section 5 to form an electrostatic latent image on the peripheral surface of the associated photosensitive drum 121. The exposure device 124 is a so-called laser exposure device and includes: a laser light source capable of outputting a laser beam; a polygon mirror capable of reflecting the laser beam toward the surface of the photosensitive drum 121; and optical elements, such as a lens and a mirror, for guiding the laser light reflected by the polygon mirror to the photosensitive drum 121.

The developing device 122 is configured to supply toner to the electrostatic latent image on the peripheral surface of the photosensitive drum 121 rotating in the direction of the arrow to transfer the toner to the peripheral surface of the photosensitive drum 121, thereby forming a toner image corresponding to the image data on the peripheral surface of the photosensitive drum 121.

The intermediate transfer belt 125 is disposed above the photosensitive drums 121. The intermediate transfer belt 125 is mounted in an endlessly movable manner between the drive roller 125*a* located to the left in FIG. 1 and a driven roller 125*b* located to the right in FIG. 1 and the lower portion of the outer peripheral surface engages against each of the peripheral surfaces of the photosensitive drums 121. The driven roller 125*b* is provided opposite to the drive roller 125*a* and rotates to follow the endless travel of the intermediate transfer belt 125. The outer peripheral surface of the intermediate transfer belt 125 is set as an image carrying surface to which a toner image is to be transferred. The intermediate transfer belt 125 can be driven by the drive roller 125*a* while engaging against the peripheral surfaces of the photosensitive drums 121. The intermediate transfer belt 125 endlessly travels between the drive roller 125*a* and the driven roller 125*b* while synchronizing with the rotation of each photosensitive drum 121.

Each primary transfer roller 126 is provided facing the associated photosensitive drum 121 with the intermediate transfer belt 125 interposed therebetween. A primary transfer bias can be applied to the primary transfer roller 126 by an unshown primary transfer bias application mechanism. Thus, the primary transfer roller 126 transfers the toner image formed on the outer peripheral surface of the associated photosensitive drum 121 to the surface of the intermediate transfer belt 125.

The drive roller 125*a* is configured to cause the intermediate transfer belt 125 to endlessly travel by a rotary drive force given from a drive motor (not shown) capable of being driven under the control of an unshown control section.

A control section 10 (FIG. 2) is configured to control the primary transfer roller 126 and image forming unit 120 in each of the image forming units for different colors to perform the transfer of a magenta toner image formed by the magenta image forming unit 12M to the surface of the intermediate transfer belt 125, then the transfer of a cyan toner image formed by the cyan image forming unit 12C to the same position of the intermediate transfer belt 125, then the transfer of an yellow toner image formed by the yellow image forming unit 12Y to the same position of the intermediate transfer belt 125, and finally the transfer of a black toner image formed by the black image forming unit 12B to superimpose these different colored toner images one on another. Thus, a multicolor toner image is formed on the surface of the intermediate transfer belt 125 (intermediate transfer or primary transfer).

A transfer bias can be applied to the secondary transfer roller 210 by an unshown transfer bias application mechanism. The secondary transfer roller 210 is configured to transfer the multicolor toner image formed on the surface of the intermediate transfer belt 125 to a recording paper sheet conveyed from the sheet feed section 14. The secondary transfer roller 210 is provided to engage against the outer peripheral surface of the intermediate transfer belt 125 in a portion of a sheet conveyance path 190 where the intermediate transfer belt 125 is mounted around the drive roller 125*a*. The secondary transfer roller 210 forms a nip N together with the drive roller 125*a* with the intermediate transfer belt 125 interposed therebetween. At the nip N, the toner image is secondarily transferred to the recording paper sheet P. The recording paper sheet conveyed along the sheet conveyance path 190 is pressed and clamped at the nip N between the intermediate transfer belt 125 and the secondary transfer roller 210 and, thus, the toner image on the intermediate transfer belt 125 is secondarily transferred to the recording paper sheet.

A registration roller 630 is disposed upstream of the nip N between the secondary transfer roller 210 and the drive roller 125*a* in the direction of conveyance of the recording paper sheet to be conveyed by the conveyance roller 192. The registration roller 630 is configured to perform the postponement of the conveyance of the recording paper sheet or like operation in order to synchronize the timing of transfer of the toner image from the intermediate transfer belt 125 to be performed by the secondary transfer roller 210 at the upper nip N with the timing of conveyance of the recording paper sheet to the nip N to be performed by a sheet conveyance section 411 (see FIG. 2).

Each drum cleaning device 127 is provided to the left of the associated photosensitive drum 121 in FIG. 1 and configured to clean residual toner from the peripheral surface of the photosensitive drum 121. The peripheral surface of the photosensitive drum 121 cleaned by the drum cleaning device 127 moves toward the charging device 123 again for fresh charging treatment.

The vertically extending sheet conveyance path 190 is formed to the left of the image forming section 12 in FIG. 1. The sheet conveyance path 190 includes conveyance rollers 192 at appropriate locations of the sheet conveyance path 190. The pairs of conveyance rollers 192 are operable to convey a recording paper sheet fed out of the sheet feed section 14 toward the nip N and the fixing section 13. In other words, the recording paper sheet is conveyed by a conveyance mechanism composed of the pairs of conveyance rollers 192 arranged at appropriate locations.

The fixing section 13 includes: a heat roller 132 internally provided with a current-carrying heating element serving as a heating source; and a pressure roller 134 opposed to the heat roller 132. The fixing section 13 is configured to perform fixation by applying heat from the heat roller 132 to the toner image on the recording paper sheet transferred in the image forming section 12 while the recording paper sheet is passing through a fixing nip between the heat roller 132 and the pressure roller 134. The recording paper sheet on which a color image has been fixed by the completion of the fixation passes through a sheet output path 194 extended from the top of the fixing section 13 and is ejected to a sheet output tray 151 provided on the top of the lower body 111.

A cleaning section 22 is provided facing a portion of the outer peripheral surface of the intermediate transfer belt 125 at which the intermediate transfer belt 125 is mounted around the driven roller 125*b*.

The sheet feed section 14 includes: a manual feed tray 141 openably and closably provided at a right side wall of the apparatus body 11 in FIG. 1; and the sheet feed cassettes 142, 143, 144 mounted below the exposure devices 124 in the lower body 111 insertably into and removably from the lower body 111.

The manual feed tray 141 is a tray provided at a lower portion of the right side surface of the lower body 111 for the purpose of manually feeding recording paper sheets toward the image forming section 12. Each of the paper feed cassettes 142, 143, 144 contains a sheet stack formed of a plurality of recording paper sheets stacked on top of one another. Pick-up rollers 145 are provided above each of the paper feed cassettes 142, 143, 144 and configured to feed respective uppermost recording paper sheets of the sheet stacks contained in the sheet feed cassettes 142, 143, 144 to the sheet conveyance path 190.

The sheet output mechanism 15 is formed between the lower body 111 and the upper body 112. The sheet output mechanism 15 includes the sheet output tray 151 formed on the top surface of the lower body 111. The sheet output tray 151 is a tray onto which the recording paper sheet having a toner image formed thereon in the image forming section 12 is ejected after it is subjected to fixation in the fixing section 13.

The image forming apparatus 1 further includes the post-processing device 60 serving as the sheet discharge device. The post-processing device 60 includes an original document loading table 600, a punching section 601, a conveyance roller 602, a sheet cradle 603, conveyance rollers 620, an output roller pair 607, a sheet output tray 623, and a conveyance branching guide 624.

The post-processing device 60 further includes a stapler 625, a stop member 626, a conveyance roller 627, a booklet forming section 628, and a sheet output tray 629.

The original document loading table 600 is a table on which original documents to be subjected to post-processing by the post-processing device 60 serving as the sheet discharge device are to be placed.

The punching section 601 is configured to perform punching as a type of post-processing to a plurality of paper sheets P (including recording paper sheets after image formation and original documents on the original document loading table 600) carried to the punching section 601 from the output roller pair 159 of the apparatus body 11 or the original document loading table 600.

The sheet cradle 603 is configured to temporarily store paper sheets P or original documents conveyed by the conveyance rollers 602, 620 in the form of a set of paper sheets.

The output roller pair 607 is disposed at a sheet output port 606 through which the paper sheet P is to be discharged from the post-processing device 60. The output roller pair 607 is configured to discharge to the sheet output tray 623 a paper sheet P conveyed from the conveyance rollers 602, 620 and a set P1 of paper sheets conveyed from the sheet cradle 603.

The sheet output tray (the piling section) 623 can be moved up and down by lifting and lowering operations of the lifting section 605. The sheet output tray 623 is configured to receive, at the sheet receiving height near the sheet output port 606, a paper sheet P or a set P1 of paper sheets discharged through the sheet output port 606 by the output roller pair 607. Paper sheets P or sets P1 of paper sheets discharged one after another through the sheet output port 606 are piled on the sheet output tray 623.

A top surface sensor (the top surface detecting section) 650 is a sensor for detecting whether or not the trailing end, in the direction of discharge, of the top surface of a pile of paper sheets P or sets P1 of paper sheets discharged through the sheet output port 606 and piled on the sheet output tray 623 is positioned at a predetermined reference height. The mounting location of the top surface sensor 650 is a location below the sheet output port 606 and at a height where even if the top of the pile of paper sheets P or sets P1 of paper sheets already piled on the sheet output tray 623 reaches the height of the mounting location of the top surface sensor 650, the pile does not interfere with a paper sheet P or set P1 of paper sheets to be discharged next through the sheet output port 606. The distance from the sheet output port 606 to the mounting location of the top surface sensor 650 is previously determined by, for example, the manufacturer of the post-processing device 60 or the image forming apparatus 1. The top surface sensor 650 is formed of, for example, an optical sensor mechanism. The top surface sensor 650 is turned on when the lifting section 605 lifts the sheet output tray 623 and allows the top of the pile of paper sheets P or sets P1 of paper sheets on the sheet output tray 623 to intercept light from this sensor. Thus, the top surface sensor 650 detects that the sheet output tray 623 or the top of the pile of paper sheets P or sets P1 of paper sheets on the sheet output tray 623 is positioned at the height of the mounting location of the top surface sensor 650. The top surface sensor 650 outputs a detection signal indicating the above detection to a control section 611 (see FIG. 2) to be described hereinafter.

A discharge sensor (the discharge detecting section) 651 is a mechanical switching mechanism disposed immediately upstream or downstream of the output roller pair 607 in the direction of conveyance of paper sheets. When an upright projection of the discharge sensor 651 projecting from its mounting location toward the sheet conveyance path is pushed down by the leading end of a paper sheet P or set P1 of paper sheets being conveyed along the conveyance path by the conveyance rollers 602, 620 or the like, the discharge sensor 651 is turned on. When the trailing end of the paper sheet P or set P1 of paper sheets leaves the projection to return the projection to an upright position, the discharge sensor 651 is turned off. The discharge sensor 651 outputs a turn-on signal (high signal) and a turn-off signal (low signal)

to the control section 611 (see FIG. 2) to be described hereinafter. In this relation, the falling edge from the turn-on signal (high signal) to the turn-off signal (low signal) provides a sheet trailing end detection signal indicating that the trailing end of the paper sheet P or set P1 of paper sheets has passed the mounting location of the discharge sensor 651. The control section 611 controls the lifting section 605 using the sheet trailing end detection signal. Since the discharge sensor 651 is disposed near the output roller pair 607 provided at the sheet output port 606, the sheet trailing end detection signal can be considered as a signal indicating that the trailing end of the paper sheet P or set P1 of paper sheets has passed through the sheet output port 606 and thus the paper sheet P or set P1 of paper sheets has been discharged to the sheet output tray 623.

The stapler 625 is configured to subject paper sheets P carried to the sheet cradle 603 to stapling as a type of post-processing.

The stop member 626 is configured to catch the lower ends of paper sheets P carried to the sheet cradle 603 and hold the paper sheets P. The conveyance roller 627 is configured to convey the paper sheet P or set P1 of paper sheets downward from the sheet cradle 603.

The booklet forming section 628 is configured to fold the set P1 of paper sheets conveyed from the conveyance roller 627 in the middle to form it into a booklet. The sheet output tray 629 is a tray to which the set P1 of paper sheets formed in a booklet by the booklet forming section 628 is to be discharged.

The sheet cradle 603 includes a drive part (not shown) operable to move the stop member 626 in the direction of discharge of the set P1 of paper sheets. When the drive part is activated in response to a control signal from the control section 611 (see FIG. 2), the set P1 of paper sheets held on the stop member 626 is conveyed to the output roller pair 607 and then discharged through the sheet output port 606 to the sheet output tray 623 by the output roller pair 607.

The stapler 625 is configured to be movable by an unshown drive part operable by a control signal from the control section 611. In subjecting paper sheets P carried to the sheet cradle 603 to normal stapling, the stapler 625 is moved to a position near one ends of the paper sheets P and applies a staple or staples to portions of the paper sheets P near the one ends thereof. In bringing the paper sheets P into a booklet style, the stapler 625 is moved to a position near the middles of the paper sheets P and applies staples to portions of the paper sheets P near the middles thereof to obtain a saddle-stitched set P1 of paper sheets.

The booklet forming section 628 includes: a saddle-stitched sheet set cradle 635 on which the set P1 of paper sheets saddle-stitched by the stapler 625 is to be placed; a conveyance roller 631 operable to carry, to the saddle-stitched sheet set cradle 635, the set P1 of paper sheets conveyed from the conveyance roller 627; a combination of a push member 632 and a center-folding roller pair 633 opposed to each other to hold therebetween a midportion of the set P1 of paper sheets placed on the saddle-stitched sheet set cradle 635 from the front and back of the set P1 of paper sheets; and an output roller pair 634 operable to discharge, to the sheet output tray 629, the set P1 of paper sheets center-folded in a booklet by the center-folding roller pair 633.

The lifting section 605 includes: two pulleys rotatable by a drive force applied from an unshown drive source; a belt mounted on the two pulleys and configured to rotate with the rotation of the pulleys; and a guide allowing the up-and-down movement of the sheet output tray 623 along the direction of translational movement generated by the rotation of the belt. The sheet output tray 623 is attached at its side to the belt. The control section 611 controls the driving of the drive source to allow the lifting section 605 to lift and lower the sheet output tray 623.

Furthermore, in the image forming apparatus 1, the setting for post-processing of paper sheets P, the setting for forming paper sheets P having images transferred thereto into a booklet, and like settings can be implemented by an operator's entry of operation commands via an operating section (described hereinafter) of the image forming apparatus 1.

Figure 2:
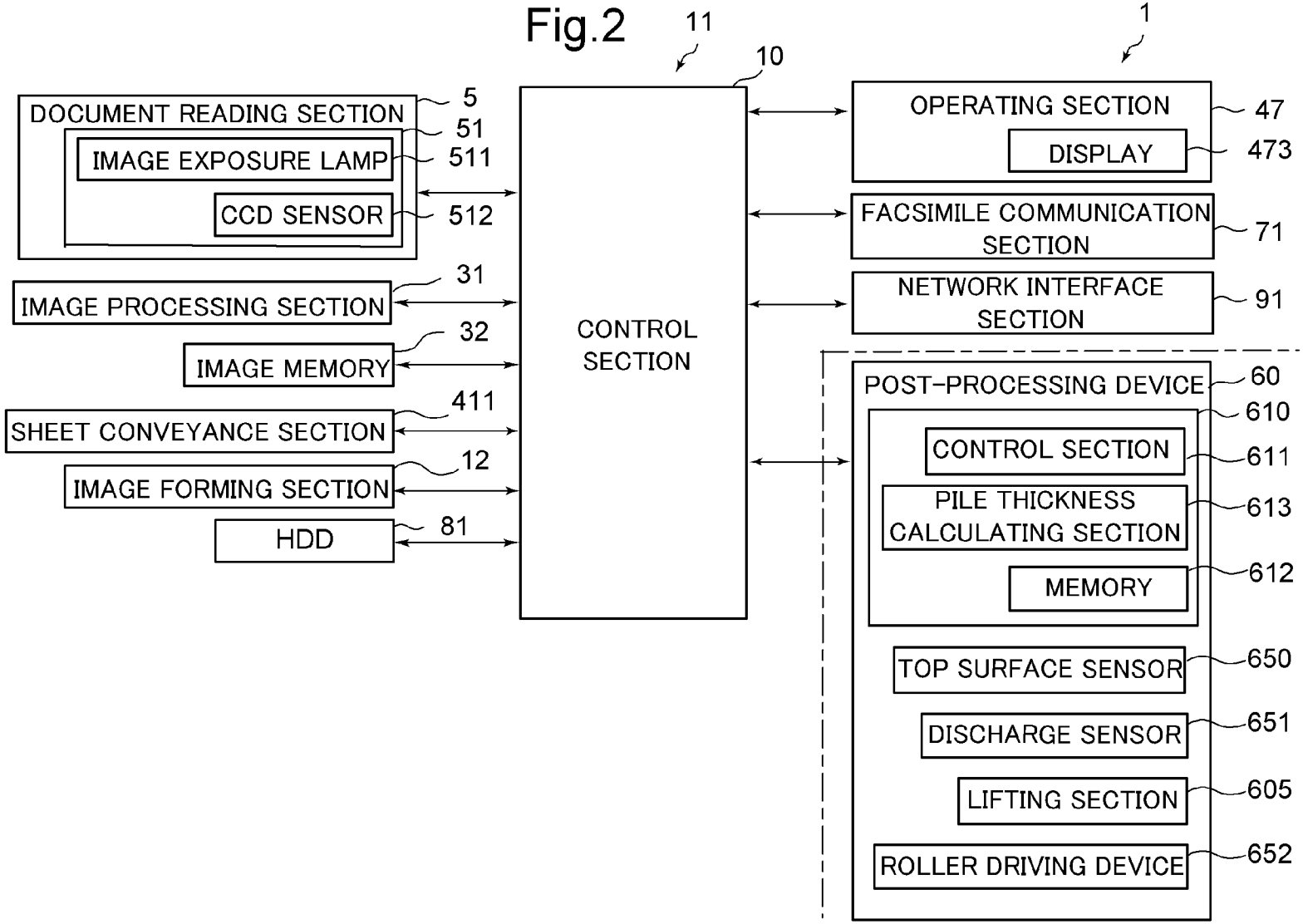
FIG. 2 is a functional block diagram showing an internal configuration of the image forming apparatus.

Next, a description will be given of an electric configuration of the image forming apparatus 1 equipped with the post-processing device 60. FIG. 2 is a functional block diagram schematically showing an essential internal structure of the image forming apparatus 1.

The image forming apparatus 1 includes a control section 10. The control section 10 is composed of a CPU (central processing unit), a RAM, a ROM, a dedicated hardware circuit, and so on and governs the overall operation control of the image forming apparatus 1.

Furthermore, the control section 10 is connected to the document reading section 5, an image processing section 31, an image memory 32, the sheet conveyance section 411, the image forming section 12, an operating section 47, a facsimile communication section 71, a network interface section 91, an HDD (hard disk drive) 81, and so on. The control section 10 performs the operation control of the above mechanisms connected thereto and signal or data transfer to and from the mechanisms.

The control section 10 controls the driving and processing of each of the above mechanisms necessary to perform the operation control of each of the scan function, the print function, the copy function, and the facsimile function in accordance with a command to execute a job entered by a user via the operating section 47, a network-connected personal computer or the like.

The document reading section 5 includes a scanner section 51 formed of the aforementioned reader 163 which includes: an image exposure lamp 511 and a CCD (charge coupled device) sensor 512. The document reading section 5 is configured to read an image from an original document by irradiating the document with light from the image exposure lamp 511 and receiving the reflected light on the CCD sensor 512.

The image processing section 31, if necessary, processes image data of the image read by the document reading section 5. For example, in order that the image read by the document reading section 5 is improved in quality after the formation of an image in the image forming section 12, the image processing section 31 performs predetermined image processing. The image data processed by the image processing section 31 is stored in the image memory 32 or output to the image forming section 12, the facsimile communication section 71 or so on.

The image memory 32 stores image data read by the document reading section 5 or other data.

The sheet conveyance section 411 is composed of the pick-up rollers 145 and the conveyance roller 192 shown in FIG. 1 and so on and configured to convey a paper sheet P contained in the manual feed tray 141 or the sheet feed cassette 142, 143, 144 via the image forming section 12 and the post-processing device 60 to the output roller pair 607 and the sheet output port 606.

The image forming section 12 includes, as described previously, the image forming units 12M, 12C, 12Y, 12B, the intermediate transfer belt 125 mounted on the drive roller 125*a*, and the secondary transfer roller 210. The image data to be output by the image forming section 12 is of various types, including image data read by the document reading section 5 and image data transmitted via the network interface section 91 from a client computer or the like in a local area. In the description herein with reference to FIG. 2, the image forming 12 includes the fixing section 13. The image forming section 12 in FIG. 2 is an example of the image forming section defined in What is claimed is.

The operating section 47 includes, as shown in not only FIG. 2 but also FIG. 1, a touch panel section and an operating key section which are configured to receive user's commands for various types of operations and processing executable by the image forming apparatus 1. The touch panel section includes a display 473, such as an LCD (liquid crystal display), provided with a touch panel.

The facsimile communication section 71 includes a coding/decoding section, a modulation/demodulation section, and an NCU (network control unit), all of which are not illustrated, and is configured to perform facsimile communication using a public telephone network. More specifically, the facsimile communication section 71 is configured to transmit, via the telephone network to a facsimile apparatus or the like, for example, image data of an original document read by the document reading section 5, and receive via the telephone network image data transmitted from a facsimile apparatus or the like.

The HDD 81 is capable of storing image data read by the document reading section 5 or other data. The image data stored on the HDD 81 is used for the formation of images by the image forming section 12 and can be transmitted to a client computer connected via a network to the image forming apparatus 1.

The network interface section 91 is constituted by a communication module, such as a LAN board, and configured to transfer various data to and from apparatuses (such as personal computers) in a local area via a LAN or the like connected to the network interface section 91.

The control section 10 is also connected to the post-processing device 60. The post-processing device 60 includes a control unit 610, the top surface sensor 650, the discharge sensor 651, the lifting section 605, and a roller driving device 652. Although the post-processing device 60 also includes the other mechanisms described previously, the following description will be given only of the mechanisms relating to the control of up-and-down movement of the sheet output tray 623.

The control unit 610 is composed of a CPU, a RAM, a ROM, a dedicated hardware circuit, and so on. The control unit 610 includes the control section 611, a pile thickness calculating section 613, and a memory 612.

The control section 611 governs the overall operation control of the post-processing device 60. The control section 611 cooperates through communications with the control section 10 on the apparatus body 11 side to control the operations of the mechanisms of the post-processing device 60 or indirectly control the operative mechanisms on the apparatus body 11 side, such as the display 473. Furthermore, the control section 611 acquires detection results from the top surface sensor 650 and the discharge sensor 651 and controls the operation of the lifting section 605 according to the acquired detection results. Although in this embodiment the control section 611 and the pile thickness calculating section 613 are provided in the post-processing device 60, it is also possible to provide the control section 611 and the pile thickness calculating section 613 on the apparatus body 11 side, that is, to allow the control section 10 to function as the control section 611 and the pile thickness calculating section 613.

When the discharge sensor 651 detects that a paper sheet P or a set P1 of paper sheets has been discharged through the sheet output port 606 to the sheet output tray 623 by the output roller pair 607, the control section 611 controls the lifting section 605 to lower the sheet output tray 623 by a predetermined certain amount. This predetermined certain amount is previously defined by, for example, the manufacturer of the post-processing device 60 or the image forming apparatus 1 and previously set by the control section 611. The predetermined certain amount is an amount of lowering enough to, when a paper sheet P or a set P1 of paper sheets is discharged through the sheet output port 606 to the sheet output tray 623, keep the trailing end of the discharged paper sheet P or set P1 of paper sheets away from the sheet output port 606 or move the pile of paper sheets P or sets P1 of paper sheets or change its piling-up condition in order to maintain the alignment of the pile on the sheet output tray 623.

Furthermore, following the above control of allowing the lifting section 605 to lower the sheet output tray 623, the control section 611 controls the lifting section 605 to lift the sheet output tray 623 from a lowered position where the sheet output tray 623 lowered by the above certain amount is located to a position where the trailing end, in the direction of discharge, of the top surface of the pile of paper sheets P or sets P1 of paper sheets on the sheet output tray 623 is detected by the top surface sensor 650.

The pile thickness calculating section 613 is configured to calculate, from the type and the number of paper sheets P constituting each of the sets P1 of paper sheets discharged through the sheet output port 606 and the number of the discharged sets P1 of paper sheets, the thickness of the pile, at the leading end thereof in the direction of discharge, of the sets P1 of paper sheets on the sheet output tray 623, calculate the thickness of the pile, at the trailing end thereof in the direction of discharge, of the sets P1 of paper sheets P1 on the sheet output tray 623 from the amount of movement of the lifting section 605, and calculate the angle of inclination of the uppermost of the sets P1 of paper sheets piled on the sheet output tray 623 with respect to the horizontal plane from the calculated thicknesses of the pile, at the leading and trailing ends thereof in the direction of discharge, of the sets P1 of paper sheets on the sheet output tray 623, the height of inclination of the sheet output tray 623, and the length of the paper sheets P.

The roller driving device 652 is a power source, such as a motor, for applying a rotary drive force to the output roller pair 607. The operation of the roller driving device 652 is controlled by the control section 611. The roller driving device 652 is also configured to apply a rotary drive force to the other rollers, such as the conveyance rollers 602, 620. In this embodiment, a combination of the roller driving device 652, the output roller pair 607, and the conveyance rollers 602, 620 is an example of the sheet discharge section defined in What is claimed is.

Figure 3:
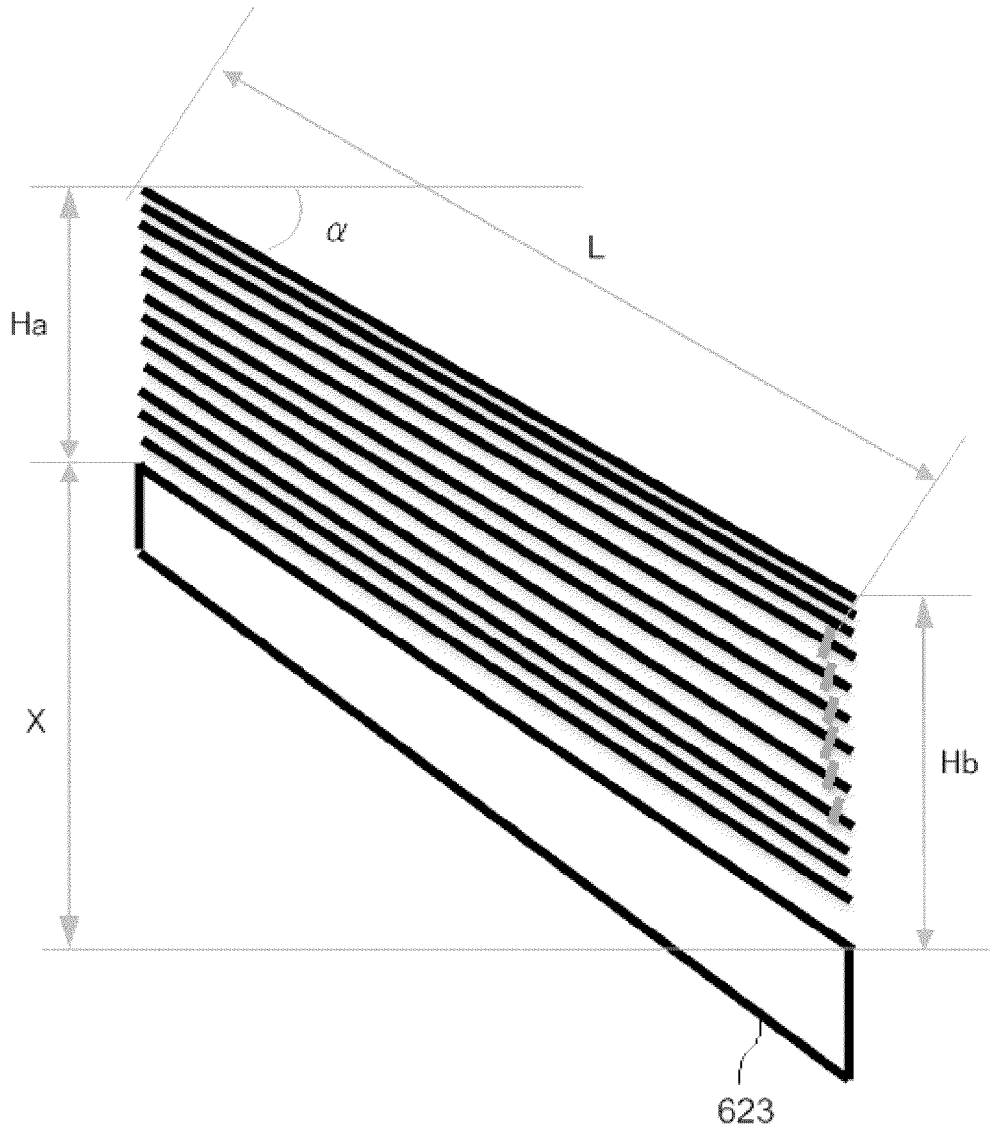
FIG. 3 is a view showing the thicknesses of a pile, at the leading and trailing ends in the direction of discharge, of sets of paper sheets on a sheet output tray, the height of inclination of the sheet output tray, the length of the paper sheets, and the angle of inclination of the uppermost paper sheet in the pile of sets of paper sheets.

FIG. 3 is a view showing the thickness of a pile, at the leading and trailing ends in the direction of discharge, of sets P1 of paper sheets on the sheet output tray 623, the height of inclination of the sheet output tray 623, the length of the paper sheets P, and the angle of inclination of the uppermost paper sheet P in the pile of sets P1 of paper sheets. The pile thickness calculating section 613 is configured to calculate, from the type and the number of paper sheets constituting each of the sets P1 of paper sheets discharged through the sheet output port 606 and the number of the discharged sets P1 of paper sheets, the thickness Ha of the pile, at its leading end in the direction of discharge, of the sets P1 of paper sheets on the sheet output tray 623. Specifically, the pile thickness calculating section 613 calculates the thickness Ha by multiplying the thickness per paper sheet P by the number of discharged paper sheets (given by multiplying the number of paper sheets P constituting each of discharged sets P1 of paper sheets by the number of discharged sets P1 of paper sheets). Furthermore, the pile thickness calculating section 613 is configured to calculate the thickness Hb of the pile, at its trailing end in the direction of discharge, of the sets P1 of paper sheets on the sheet output tray 623 from the amount of movement of the lifting section 605. Moreover, the pile thickness calculating section 613 is configured to calculate the angle α of inclination of the uppermost of the sets P1 of paper sheets piled on the piling surface of the sheet output tray 623 with respect to the horizontal plane from the thicknesses Ha, Hb, the height X from the lowermost end to uppermost end of the piling surface of the sheet output tray 623, and the length L of the paper sheets P. Specifically, the pile thickness calculating section 613 calculates a according to the following calculation formula:

$$\alpha=\arcsin((Ha+X-Hb)/L)$$

By calculating the angle α of inclination in this manner, the pile thickness calculating section 613 can accurately calculate the inclination of the uppermost of the sets P1 of paper sheets piled on the sheet output tray 623, regardless of the thickness of each of paper sheets P to be stapled.

The control section 611 is further configured to control the operation of the sheet discharge section to change the manner of discharging subsequent paper sheets P according to the angle α of inclination calculated by the pile thickness calculating section 613. For example, when the calculated angle α of inclination is smaller than a predetermined angle, the control section 611 controls the operation of the sheet discharge section to discharge each subsequent stapled set P1 of paper sheets through the sheet output port 606 to a location offset in the direction of discharge of the set P1 of paper sheets or a direction perpendicular to the direction of discharge at each time of discharge of the stapled set P1 of paper sheets or allow the sheet discharge section to discharge the subsequent stapled sets P1 of paper sheets, face up and face down alternately every predetermined number of sets, through the sheet output port 606. Thus, sets P1 of paper sheets can be piled as many as possible on the sheet output tray 623 to the brink of collapse of the pile of sets P1 of paper sheets on the sheet output tray 623.

If sets P1 of paper sheets are further piled until the angle α of inclination becomes nearly horizontal, it is highly likely that a subsequent set P1 of paper sheets discharged through the sheet output port 606 may slide off the sheet output tray 623 or the pile of sets P1 of paper sheets on the sheet output tray 623 may collapse. In such a case (in the case where the angle α of inclination becomes nearly horizontal), the control section 611 stops the operation of the sheet discharge section to prevent the roller driving device 652 from operating and thus stop the output roller pair 607 from discharging the next set P1 of paper sheets to the sheet output tray 623. This stop includes temporary stop and waiting. As will be described hereinafter, when the control section 611 stops the discharge of the set P1 of paper sheets, the user is given a warning notice.

Figure 4:
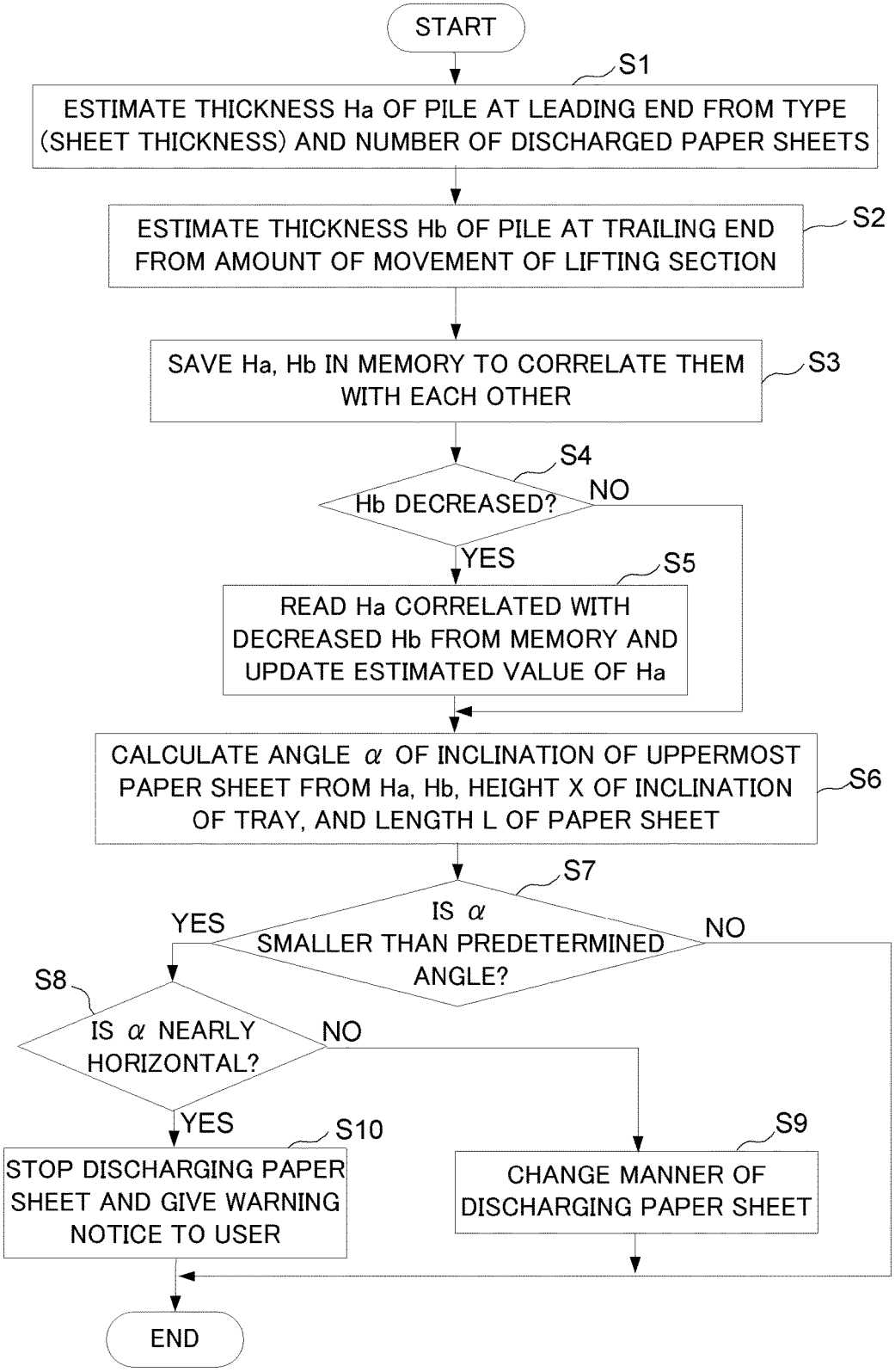
FIG. 4 is a flowchart showing processing for discharging a set of paper sheets in a post-processing device.

Next, a description will be given of processing for discharging a set P1 of paper sheets in the post-processing device 60. FIG. 4 is a flowchart showing processing for discharging a set P1 of paper sheets in the post-processing device 60.

First, when acquiring from the discharge sensor 651 the aforementioned detection signal indicating the completion of discharge of a set P1 of paper sheets, the control section 611 actuates the lifting section 605 to lower the sheet output tray 623 by the aforementioned certain amount. In other words, upon discharge of the set P1 of paper sheets through the sheet output port 606 to the sheet output tray 623, the control section 611 allows the sheet output tray 623 to descend by the certain amount. Thus, the trailing end of the set P1 of paper sheets in the direction of discharge is certainly moved away from the sheet output port 606 to maintain the alignment of the pile of sets P1 of paper sheets on the sheet output tray 623. Then, the pile thickness calculating section 613 calculates, from the type and the number of paper sheets P constituting each of the sets P1 of paper sheets discharged through the sheet output port 606 and the number of the discharged sets P1 of paper sheets, the thickness Ha of the pile, at its leading end in the direction of discharge, of the sets P1 of paper sheets on the sheet output tray 623 (S1).

The control section 611 allows the lifting section 605 to lower the sheet output tray 623 by the aforementioned certain amount and then allows the lifting section 605 to lift the sheet output tray 623 from the lowered position. When, following the start of the above lifting, the top surface sensor 650 detects the trailing end of the top surface of the pile of sets P1 of paper sheets on the sheet output tray 623 and the control section 611 receives a top surface detection signal from the top surface sensor 650, the control section 611 allows the lifting section 605 to stop lifting the sheet output tray 623. Then, the pile thickness calculating section 613 calculates the thickness Hb of the pile, at its trailing end in the direction of discharge, of the sets P1 of paper sheets from the amount of movement of the sheet output tray 623 up to that point in time (S2). More specifically, the amount of movement of the sheet output tray 623 is calculated from the time taken for the sheet output tray 623 to move until receipt of the top surface detection signal and the amount of movement of the sheet output tray 623 per unit time, which is a predetermined value. The pile thickness calculating section 613 saves the calculated thicknesses Ha and Hb in the memory 612 to correlate them with each other (S3).

Then, the control section 611 determines whether or not the thickness Hb has decreased (S4). For example, the thickness Hb decreases when some of the sets P1 of paper sheets piled on the sheet output tray 623 is removed. If the thickness Hb has decreased (YES in S4), the control section 611 reads the thickness Ha correlated with the decreased thickness Hb from the memory 612 to update the value of Ha calculated in step S1 (S5). On the other hand, if the thickness Hb does not decrease (NO in S4), the process proceeds to step S6.

Next, the pile thickness calculating section 613 calculates the angle α of inclination of the uppermost of the sets P1 of paper sheets piled on the sheet output tray 623 according to the aforementioned calculation formula from the thicknesses Ha, Hb, the height X of the sheet output tray 623, and the length L of the paper sheets P (S6). Then, if the control section 611 determines that the angle α of inclination calculated in S6 is the predetermined angle (for example, 10 degrees) or more (NO in S7), it executes no other special processing and continues normal processing for discharging paper sheets.

On the other hand, if the control section 611 determines that the angle α of inclination calculated in S6 is smaller than the predetermined angle (YES in S7), it further determines whether or not the angle α of inclination is horizontal or substantially horizontal (S8). If the angle α of inclination is neither horizontal nor substantially horizontal (NO in S8), the control section 611 controls the sheet discharge section to change the manner of discharging subsequent sets P1 of paper sheets, such as by allowing the sheet discharge section to discharge each subsequent stapled set P1 of paper sheets through the sheet output port 606 to a location offset on the sheet output tray 623 at each time of discharge of the stapled set P1 of paper sheets or by controlling the sheet discharge section to discharge the subsequent stapled sets P1 of paper sheets, face up and face down alternately every predetermined number of sets, through the sheet output port 606 (S9).

If the control section 611 determines that the angle α of inclination is horizontal or substantially horizontal (YES in S8), it gives the control section 10 of the image forming apparatus 1 notice to stop forming an image in order to stop further discharge of a set P1 of paper sheets, gives the control section 10 of the image forming apparatus 1 a command requesting execution of display on the display (notifying section) 473, and allows the control section 10 to control the display 473 to display a warning indicating that the sheet output tray 623 is fully piled with paper sheets (S10). This warning may be implemented, for example, by providing the post-processing device 60 with a lighting device, such as a lamp, and allowing the control section 611 to control the lighting-up of the lighting device.

As thus far described, according to this embodiment, since the pile thickness calculating section 613 calculates, in the above manner, the angle α of inclination of the uppermost of sets P1 of paper sheets piled on the sheet output tray 623 (S6), the control section 611 can more accurately than ever before determine, based on the angle α of inclination, whether or not there has arisen a situation to execute controls, such as allowing the sheet discharge section to discharge each subsequent set P1 of paper sheets to a location offset at each time of discharge of the subsequent set P1 of paper sheets or giving a warning notice.

For example, in the technique, described in BACKGROUND, for avoiding the thickness of the pile of sets of paper sheets from increasing more at its trailing end by offsetting the locations of the sets of paper sheets to be discharged from one another, the offset is controlled on the assumption that the inclination of the uppermost of sets of paper sheets piled on the sheet output tray becomes horizontal when stapling has been performed X/a times where X represents the height from the uppermost end to lowermost end of the sheet output tray and a represents the difference between the thickness of a set of paper sheets to be stapled and the thickness of the same set of paper sheets after being stapled. However, the value a varies depending upon the thickness of the paper sheet to be stapled (that is, as the sheet thickness decreases, the value a tends to increase). Therefore, the inclination of the uppermost of sets of paper sheets piled on the sheet output tray cannot be accurately estimated simply by counting the number of stapling times. For this reason, subsequently discharged sets of paper sheets may still slide off the sheet output tray or the pile of sets of paper sheets on the sheet output tray may still collapse.

In the technique, also described in BACKGROUND, for avoiding the thickness of the pile of sets of paper sheets from increasing more at its trailing end by discharging the sets of paper sheets face up and face down alternately every predetermined number of sets to avoid the superposition of the stapled portions, the pile of sets of paper sheets on the sheet output tray contains sets of paper sheets discharged face up and sets of paper sheets discharged face down. This forces the user to manually align the orientation of the sets of paper sheets.

Unlike the above, according to this embodiment, in piling stapled sets P1 of paper sheets on top of one another on the sheet output tray 623, the angle α of inclination of the uppermost of the sets P1 of paper sheets can be accurately calculated. Thus, it can be certainly prevented that the sets P1 of paper sheets slide off the sheet output tray 623 and the pile of sets P1 of paper sheets on the sheet output tray 623 collapses.

Although the embodiment of the present disclosure has thus far been described, the present disclosure is not limited to the above embodiment and can be modified in various ways. For example, although the description of the above embodiment is given taking a multifunction peripheral as an example of the image forming apparatus according to the present disclosure, the example is merely illustrative and the image forming apparatus may be any other electronic image forming apparatus, such as a printer, a copier or a facsimile machine.

The structure shown in the above embodiment with reference to FIGS. 1 to 4 is merely illustrative of the present disclosure and not intended to limit the scope of the present disclosure to the above particular structure.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A sheet discharge device comprising:

a sheet discharge section configured to discharge a set of paper sheets through a sheet output port;

a stapler configured to, before the set of paper sheets is discharged through the sheet output port, apply a staple to a predetermined location on a trailing end portion of the set of paper sheets in a direction of discharge thereof;

a piling section capable of being piled with sets of paper sheets discharged through the sheet output port, while a pile of the sets of paper sheets on the piling section being inclined so that a trailing end of the pile of the sets of paper sheets in the direction of discharge is located below a leading end thereof in the direction of discharge;

a lifting section configured to vertically lift and lower the piling section toward and away from the sheet output port;

a top surface detecting section configured to detect that a trailing end, in the direction of discharge, of a top surface of the pile of the sets of paper sheets on the piling section capable of being lifted and lowered by the lifting section has reached a predetermined sheet receiving height;

a discharge detecting section configured to detect that the set of paper sheets has been discharged through the sheet output port to the piling section;

a control section configured to, when the discharge detecting section detects that the set of paper sheets has been discharged to the piling section, allow the lifting section to lower the piling section by a certain amount and then lift the piling section from a lowered position where the piling section lowered by the certain amount is located to a position where the trailing end, in the direction of discharge, of the top surface of the pile of the sets of paper sheets on the piling section is detected by the top surface detecting section; and a pile thickness calculating section configured to calculate, from a type and the number of paper sheets constituting each of the sets of paper sheets discharged through the sheet output port and the number of the discharged sets of paper sheets, a thickness of the pile, at the leading end thereof in the direction of discharge, of the sets of paper sheets on the piling section, calculate a thickness of the pile, at the trailing end thereof in the direction of discharge, of the sets of paper sheets on the piling section from an amount of movement of the piling section from the lowered position to the position where the trailing end of the top surface of the pile in the direction of discharge is detected by the top surface detecting section, and calculate an angle of inclination of the uppermost of the sets of paper sheets piled on the piling section with respect to a horizontal plane from the calculated thicknesses of the pile, at the leading and trailing ends in the direction of discharge, of the sets of paper sheets on the piling section, a height of inclination of the piling section, and a length of the paper sheets constituting the pile of the sets of paper sheets, wherein the control section is further configured to control the sheet discharge section to change a manner of discharging a subsequent set of paper sheets according to the calculated angle of inclination.

2. The sheet discharge device according to claim 1, wherein the pile thickness calculating section is configured to calculate the angle of inclination according to the formula $\alpha=\arcsin((Ha+X-Hb)/L)$ where $\alpha$ represents the angle of inclination, Ha represents a thickness of the pile, at the leading end thereof in the direction of discharge, of the sets of paper sheets on the piling section, X represents a height from a lowermost end to an uppermost end of a piling surface of the piling section on which the paper sheets are piled, Hb represents a thickness of the pile, at the trailing end thereof in the direction of discharge, of the sets of paper sheets on the piling section, and L represent a length of the paper sheet in the direction of discharge.

3. The sheet discharge device according to claim 1, wherein when the angle of inclination is smaller than a predetermined angle, the control section allows the sheet discharge section to discharge each subsequent stapled set of paper sheets through the sheet output port to a location offset in the direction of discharge or a direction perpendicular to the direction of discharge at each time of discharge of the stapled set of paper sheets.

4. The sheet discharge device according to claim 1, wherein when the angle of inclination is smaller than a predetermined angle, the control section allows the sheet discharge section to discharge subsequent stapled sets of paper sheets, face up and face down alternately every predetermined number of sets, through the sheet output port.

5. The sheet discharge device according to claim 1, wherein the pile thickness calculating section is configured to save, in a memory as needed, the thicknesses of the pile, at the leading and trailing ends thereof in the direction of discharge, of the sets of paper sheets on the piling section to correlate the thicknesses with each other and configured to, when some of the sets of paper sheets piled on the piling section is removed so that the thickness of the pile at the trailing end thereof in the direction of discharge decreases, read the thickness of the pile at the leading end thereof in the direction of discharge, the thickness being correlated with the decreased thickness of the pile at the trailing end thereof in the direction of discharge, from the memory and update the calculated value of the thickness of the pile, at the leading end thereof in the direction of discharge, of the sets of paper sheets on the piling section to the read thickness.

6. The sheet discharge device according to claim 1, wherein when the angle of inclination becomes nearly horizontal, the control section allows the sheet discharge section to stop discharging a next paper sheet to the piling section.

7. An image forming apparatus comprising:

a sheet discharge device;

an image forming section configured to form an image on a paper sheet; and a notifying section configured to give notice to a user, wherein the sheet discharge device comprises:

a sheet discharge section configured to discharge a set of paper sheets through a sheet output port;

a stapler configured to, before the set of paper sheets is discharged through the sheet output port, apply a staple to a predetermined location on a trailing end portion of the set of paper sheets in a direction of discharge thereof;

a piling section capable of being piled with sets of paper sheets discharged through the sheet output port, while a pile of the sets of paper sheets on the piling section being inclined so that a trailing end of the pile of the sets of paper sheets in the direction of discharge is located below a leading end thereof in the direction of discharge;

a lifting section configured to vertically lift and lower the piling section toward and away from the sheet output port;

a top surface detecting section configured to detect that a trailing end, in the direction of discharge, of a top surface of the pile of the sets of paper sheets on the piling section capable of being lifted and lowered by the lifting section has reached a predetermined sheet receiving height;

a discharge detecting section configured to detect that the set of paper sheets has been discharged through the sheet output port to the piling section;

a control section configured to, when the discharge detecting section detects that the set of paper sheets has been discharged to the piling section, allow the lifting section to lower the piling section by a certain amount and then lift the piling section from a lowered position where the piling section lowered by the certain amount is located to a position where the trailing end, in the direction of discharge, of the top surface of the pile of the sets of paper sheets on the piling section is detected by the top surface detecting section; and a pile thickness calculating section configured to calculate, from a type and the number of paper sheets constituting each of the sets of paper sheets discharged through the sheet output port and the number of the discharged sets of paper sheets, a thickness of the pile, at the leading end thereof in the direction of discharge, of the sets of paper sheets on the piling section, calculate a thickness of the pile, at the trailing end thereof in the direction of discharge, of the sets of paper sheets on the piling section from an amount of movement of the piling section from the lowered position to the position where the trailing end of the top surface of the pile in the direction of discharge is detected by the top surface detecting section, and calculate an angle of inclination of the uppermost of the sets of paper sheets piled on the piling section with respect to a horizontal plane from the calculated thicknesses of the pile, at the leading and trailing ends in the direction of discharge, of the sets of paper sheets on the piling section, a height of inclination of the piling section, and a length of the paper sheets constituting the pile of the sets of paper sheets, and wherein the control section is further configured to control the sheet discharge section to change a manner of discharging a subsequent set of paper sheets according to the calculated angle of inclination and configured to, when the angle of inclination becomes nearly horizontal, allow the sheet discharge section to stop discharging a next paper sheet to the piling section and allow the notifying section to give a warning notice to the user.

* * * * *